US005857513A

United States Patent [19]

Calhoun et al.

[11] Patent Number: 5,857,513

[45] Date of Patent: Jan. 12, 1999

[54] AERATOR FOR VERTICAL FLASKLESS MOLDING MACHINE

[75] Inventors: Gary W. Calhoun, Avon; George Ducis, Brunswick, both of Ohio

[73] Assignee: Brunswick Industrial Inc., Cleveland, Ohio

[21] Appl. No.: 897,385

[22] Filed: Jul. 21, 1997

Related U.S. Application Data

[63] Continuation of Ser. No. 326,079, Oct. 19, 1994, abandoned.

[51] Int. Cl.[6] ..... B22C 5/04; B22C 15/28

[52] U.S. Cl. ..... 164/159; 164/169; 164/200; 366/155.2

[58] Field of Search ..... 164/159, 169, 164/195, 200, 201; 366/155.1, 155.2, 158.1, 298, 300, 297

[56] References Cited

U.S. PATENT DOCUMENTS

| | | | |
|---|---|---|---|
| 1,413,345 | 4/1922 | Morris | 366/155.2 |
| 3,238,575 | 3/1966 | Taccone | 164/169 |
| 3,244,408 | 4/1966 | Brownlie et al. | 366/300 |
| 3,802,484 | 4/1974 | Ovodov et al. | 164/169 |
| 4,560,281 | 12/1985 | Harris et al. | 366/300 X |
| 4,619,381 | 10/1986 | Wurtz | 366/155.1 X |
| 4,712,919 | 12/1987 | Bouldin | 366/155.2 X |
| 5,094,541 | 3/1992 | Nelson | 366/298 X |

FOREIGN PATENT DOCUMENTS

| | | | |
|---|---|---|---|
| 2055274 | 5/1971 | Germany | 164/200 |
| 776031 | 5/1957 | United Kingdom | 164/201 |
| 1253091 | 11/1971 | United Kingdom | 164/40 |

*Primary Examiner*—J. Reed Batten, Jr.
*Attorney, Agent, or Firm*—Fay, Sharpe, Beall, Fagan, Minnich & McKee

[57] ABSTRACT

The assembly includes plural independently operated rotating shafts that contact the sand fill. As the fill is introduced into a first end of the vertical chute, the speed and rotational direction of the shafts with accompanying tines are controlled to regulate the feed rate and discharge of the fill to a molding chamber. This arrangement provides a more uniform density in the molding chamber which, in turn, results in improved quality in the cast product.

14 Claims, 3 Drawing Sheets

AERATOR FOR VERTICAL FLASKLESS MOLDING MACHINE

This is a continuation of application Ser. No. 08/326,079 filed on Oct. 19, 1994 and now abandoned.

BACKGROUND OF THE INVENTION

This invention pertains to the art of molding machines and more particularly to a molding machine generally referred to as a vertical flaskless molding machine in which sand received through a vertical hopper is compressed into a desired configuration defining an open top casting cavity. A series of these sand molds are then strung together and advanced along a conveyor for subsequent receipt of molten metal into the cavity at a downstream pouring station.

The invention is particularly applicable to an aerator assembly for use in a vertical molding machine of this type and will be described with particular reference thereto. However, it will be appreciated that the application has broader applications and may be advantageously employed in other related environments and applications.

Known vertical flaskless molding machines, as an example, provide a supply of sand on an inlet conveyor to a hopper where regulated amounts of the sand in the hopper are subsequently introduced into a molding chamber. Clay and other materials that comprise the sand may tend to bind and clump the sand together, a situation that is undesirable where uniform distribution or density of the sand in the mold is desired. In an effort to address binding and clumping of the sand, mold manufacturers supply an aerator assembly that mechanically aerates the supply sand. One commercially available aerator assembly uses a series of paddles, blades, or similar structures situated over the inlet conveyor. The paddles contact the sand as it is transported along the conveyor. The aerator paddles rotate in a fixed direction and at a fixed speed in an attempt to break up the sand before it enters the hopper.

Although widely used, and addressing a portion of the sand binding problems, situating the aerator assembly above the inlet conveyor still does not adequately address introduction of the sand into the mold chamber and the desired goal of uniform density. Various portions of the mold chamber have a greater density of sand than other portions of the chamber. Even though the sand is subsequently pressed to a desired shape, the variation in density can adversely effect the quality of the molded product.

Therefore, even though some aspects of the non-uniform density were addressed by these prior art arrangements, there is no ability to change the displacement and fill rate of the sand into the mold chamber. The fixed direction and speed of the paddles provide minimal aeration.

As with any mechanical device, it is also preferable that any modified aerator assembly be easily serviced and operated. Accordingly, these are still other deficiencies found in the prior art and which have been adequately addressed by the subject invention.

SUMMARY OF THE INVENTION

The present invention contemplates a new and improved aerator assembly that overcomes all of the above-referenced problems and others and provides a more uniform density of sand in a vertical flaskless molding machine. While obtaining all of these goals, the new aerator assembly is still simple and economical to manufacture, operate, and service.

According to the present invention, a chute is adapted to receive the fill (sand) at one end and discharge the fill at a second end to the molding chamber. Plural tines are disposed in the chute between the inlet and outlet and contact the fill as it proceeds vertically through the chute.

According to another aspect of the invention, the tines are mounted on separate shafts that are independently driven by separate motors in response to signals provided by independent controllers.

According to yet another aspect of the invention, the tines on respective shafts are offset relative to one another.

A principal advantage of the invention is the ability to adequately aerate the fill material as it proceeds from the upper, first end of the chute to the lower, second end thereof.

Yet another advantage results from the uniform density and greater control over the fill rate of sand introduced to the mold chamber.

A still further advantage is realized by the simplified structure that can be easily manufactured, operated, and serviced.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENTS

Figure 1:
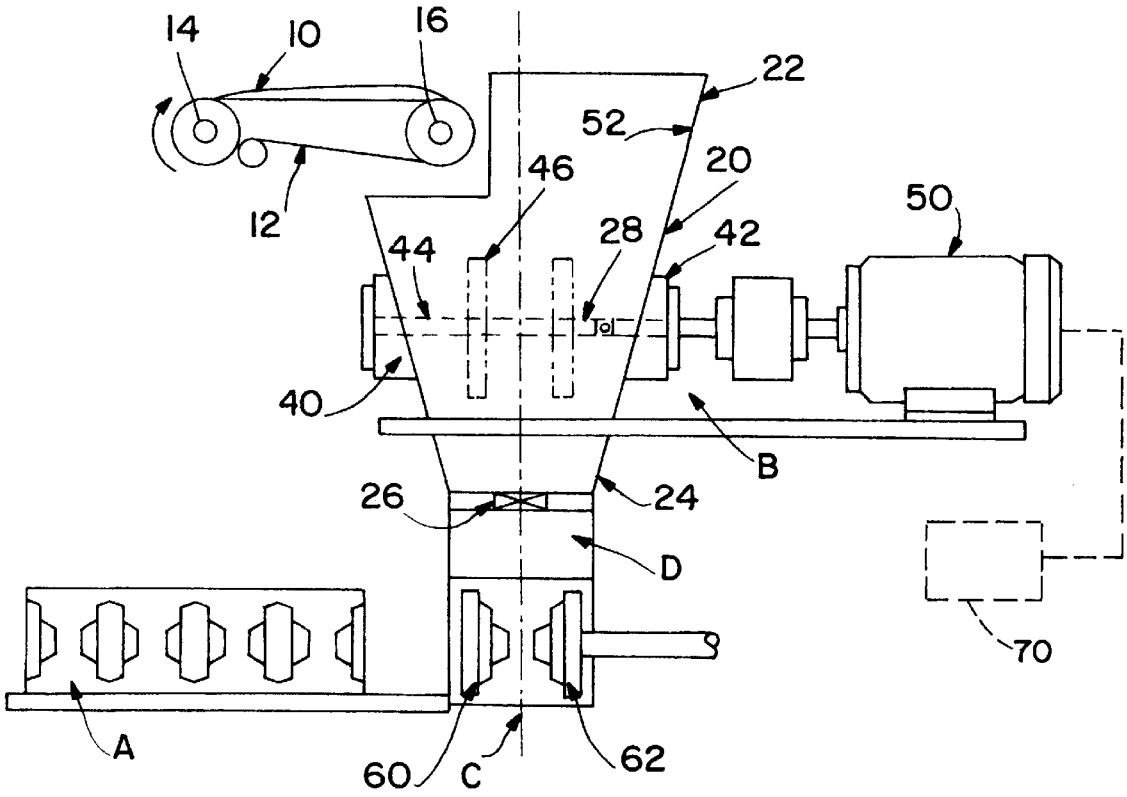
FIG. 1 is a side elevational schematic view of the subject new aerator assembly on a vertical flaskless molding machine.

Referring now to the drawings wherein the showings are for purposes of illustrating the preferred embodiment of the invention only and not for limiting same, the figures show a vertical flaskless molding machine or apparatus A that includes an aerator assembly B. More particularly, and with reference to FIG. 1, the molding machine is used to cast metal products in sand molds. A supply of molding sand 10 is typically provided on an inlet conveyor such as a continuous loop belt 12. The belt rotates in a generally clockwise direction, as shown, about rollers 14, 16. The rollers rotate about parallel, horizontal axes to feed the sand into a chute 20.

The chute 20 defines a housing of the aerator assembly B and includes a first or upper end 22 having an enlarged cross-sectional area and a second or lower end 24 having a reduced cross-sectional area. Thus, the chute has a tapered, partially conical configuration that receives the sand and funnels it toward a molding chamber C. A valve 26 is disposed in the lower end of the chute to control the input of sand fill to the molding chamber. The valve can be of any known acceptable type, such as a slide or gate valve, dome valve, butterfly valve, or the like. Moreover, a blow chamber D is located below the valve 26 and above the molding chamber. Its structure and operation form no part of the subject invention so that further discussion herein is deemed unnecessary.

Figure 2:
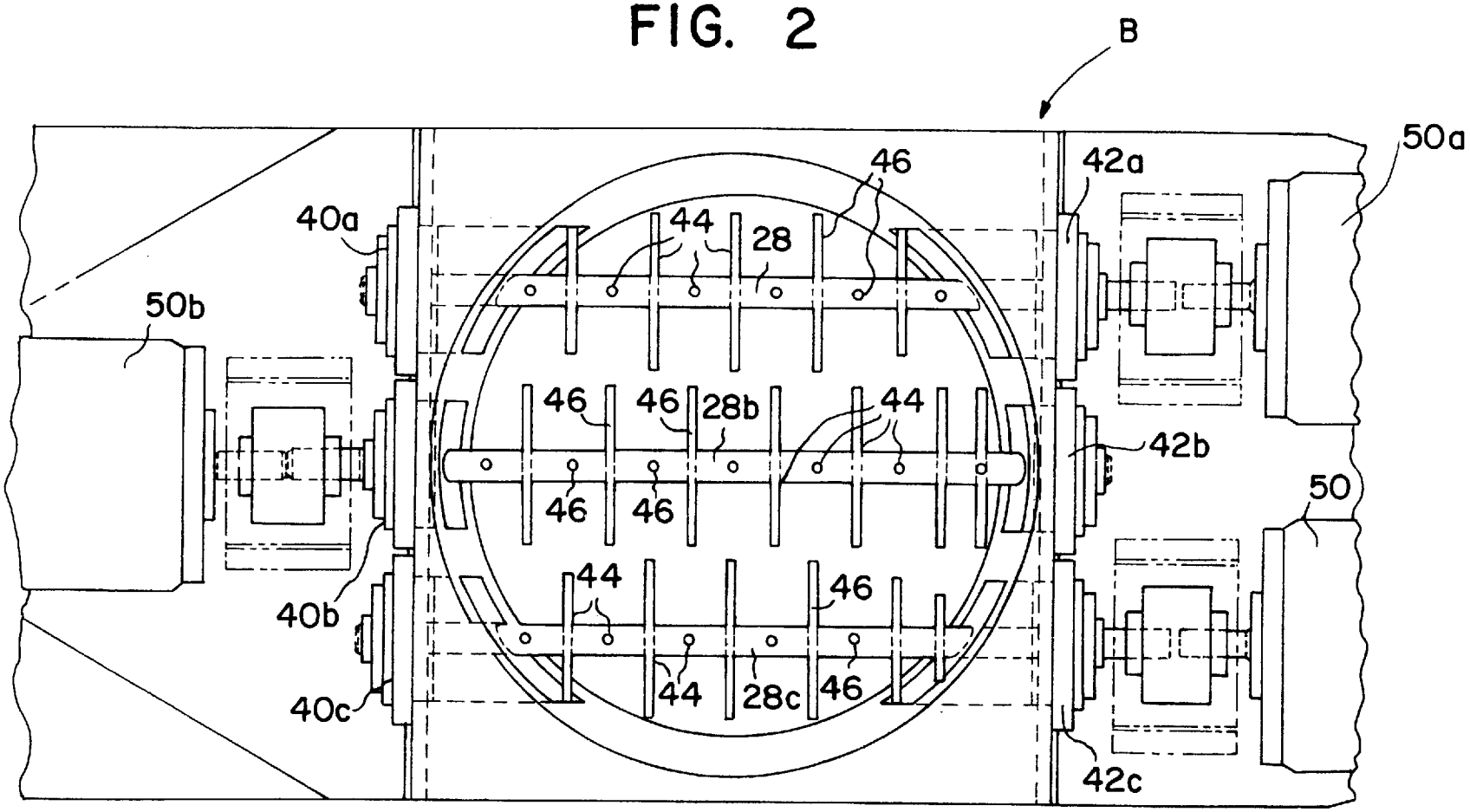
FIG. 2 is an overhead plan view of the aerator assembly.

Mounted in the chute is a mixing member defined in the preferred embodiment by a plurality of shafts or spindles 28*a*, 28*b*, 28*c* (FIG. 2). The shafts extend in a common, generally horizontal plane across an intermediate region of the chute and are each supported at opposite ends by bearing assemblies 40, 42. Each of the shafts includes a series of diametrically oriented through openings 44. The openings are spaced apart along the longitudinal axis of each shaft and are alternately oriented in generally orthogonal relation. The openings 44 are each adapted to receive a tine 46 that is preferably defined by a stainless steel roll pin. The roll pin configuration permits the tine to be inserted in one end of the opening 44 so that its cross section is reduced as it is advanced through the opening. The tine then tends to expand as it exits on the opposite side of the shaft. In this manner, the tines extend generally radially outward from their respective shafts.

As best illustrated in FIG. 2, most of the tines have the same length, although tines disposed adjacent ends of the shafts may have a reduced length to prevent contact with the sidewall of the chute 20. Moreover, the tines are oriented in alternating, orthogonal relationship along each shaft as described above and are offset from tines disposed on adjacent shafts. That is, tines disposed at relatively the same axial location on adjacent shafts are oriented 90 degrees out of phase. In any event, and due to the differing rotational speed as will be described further below, the tines are dimensioned so that they will not interfere with the tines of an adjacent shaft even when the tines are oriented in the same direction. The tines do, however, extend over substantially the entire cross-sectional area of the chute.

Each shaft is individually operated by a drive motor 50. In the illustrated preferred embodiment employing three shafts, the drive motors 50*a*, 50*b*, 50*c* are direct drive units with an associated AC inverter. A programmable logic controller (PLC) 70 is operatively connected to the drive units of the motors and the PLC controls not only the rotational speed, but also the rotational direction of the individual shafts. Thus, shaft 50*b* may be rotating in a direction opposite that of shafts 50*a* and 50*c*. Likewise, any one, or all three, of the shafts may be operated at different speeds or directions as desired for a particular application. For a particular molding operation, information may be preprogrammed in the PLC or necessary adjustments can be made via a rheostat or similar variable control arrangement if so desired.

Figure 3:
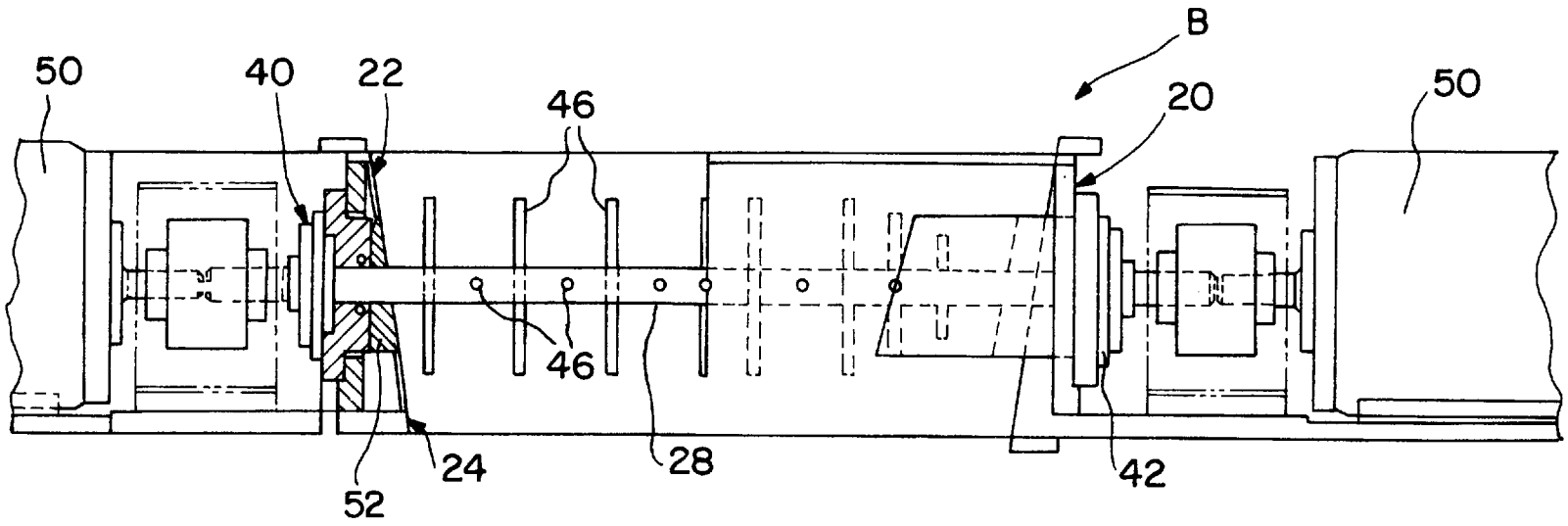
FIG. 3 is an enlarged elevational view partly in cross-section of the aerator assembly.

To facilitate passage of the sand through the chute 20, interior wall 52 (FIG. 3) of the chute is preferably formed of a lubricious material. For example, a material having an ultra-high molecular weight (UHMW) is preferred to provide a smooth surface that contributes to the overall flow of sand fill through the chute.

By controlling the operative speed and rotation of the individual shafts, the displacement and fill rate of sand to the molding chamber C can likewise be controlled. The aerator assembly contributes to discharge of sand fill at a uniform density into the chamber. It is also preferably located between the feed conveyor and the molding chamber, i.e., in the vertical path therebetween, to provide even greater accuracy and control of the fill.

Once the chamber C is filled in known vertical flaskless molding machines, valve 26 is closed and plates 60, 62 (FIG. 1) are relatively advanced toward one another to compress the sand into the desired mold configuration. After the compression stroke is complete, the sand mold is then ejected from the chamber and advanced to the end of a string of similar molds. At a downstream location molten metal is then poured into an open, upper end of adjacent molds to fill the cavities and form the desired workpiece. Details of the molding, cooling, and advancement of the mold string are well known in the art and form no part of the subject invention so that further details herein are deemed unnecessary.

It is contemplated that various alterations can be made to the preferred embodiment. For example, different orientations of the shafts and tines may be preferred for selected applications. Moreover, different control arrangements for the individual shafts may be advantageous, although it is believed that independent, individual control of each shaft is preferred. Different numbers of shafts or lengths of tines may be desired for still other applications. None of these changes, however, is deemed to significantly depart from the overall scope and content of the subject invention.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An aerator assembly for a vertical flaskless molding machine, the aerator assembly comprising:

a chute having an upper, first end adapted to receive filling material therein and a lower, second end spaced therefrom adapted for communication with associated equipment;

at least first and second rotating shafts spaced from one another in generally the same plane and extending across the chute at a region between the first and second ends, the shafts each including tines extending generally outward therefrom adapted to contact the associated filling material as it proceeds from the first end toward the second end of the chute; and first and second motors for independently rotating the first and second shafts, respectively.

2. The aerator assembly as defined in claim 1 wherein the first and second shafts are generally horizontally disposed in the chute.

3. The aerator assembly as defined in claim 1 wherein the tines extend generally radially outward from the shafts.

4. The aerator assembly as defined in claim 1 wherein the tines of the first shaft are offset relative to the tines of the second shaft.

5. The aerator assembly as defined in claim 1 further comprising a controller operatively connected to the drive member for controlling rotation of at least one of the first and second shafts.

6. The aerator assembly as defined in claim 5 wherein each shaft has its own controller and the shafts are permitted to rotate in opposite directions and at different speeds in response to input signals from the controllers.

7. The aerator assembly as defined in claim 1 wherein the chute tapers inwardly from an enlarged cross-sectional area adjacent the first end to a reduced cross-sectional area adjacent the second end.

8. The aerator assembly as defined in claim 1 wherein the chute has an interior surface formed of a lubricious material.

9. The aerator assembly as defined in claim 1 wherein the motors are direct drive motors coupled to the shafts with AC inverters.

10. The aerator assembly as defined in claim 1 wherein the tines are of different lengths.

11. An aerator assembly interposed between a sand transporting conveyor and an inlet of a vertical flaskless molding machine, the aerator assembly comprising:

a chute having an inlet adapted to receive sand from the associated conveyor and an outlet adapted for operative communication with the associated molding machine;

a plurality of shafts disposed in the chute, each shaft including tines extending outwardly for aerating the sand as it passes between the chute inlet and outlet, the tines of adjacent shafts are offset relative to and intermesh with one another and;

a drive member for rotating the shafts in a controlled fashion to equalize density of the sand within the associated molding machine, the drive member including separate motors for each shaft.

12. The aerator assembly as defined in claim 11 further comprising a controller operatively connected to the drive motors for independently rotating the shafts relative to one another.

13. The aerator assembly as defined in claim 11 wherein the chute has an interior surface formed of a lubricious material.

14. The aerator assembly as defined in claim 11 wherein the shafts are generally disposed in the same horizontal plane.

* * * * *